United States Patent [19]

Gifford, II

[11] 4,001,105

[45] Jan. 4, 1977

[54] HYDROCRACKING PROCESS FOR THE PRODUCTION OF SYNTHETIC FUELS

[76] Inventor: Phillip H. Gifford, II, Marble Star Route, Carbondale, Colo. 81623

[22] Filed: Oct. 11, 1974

[21] Appl. No.: 514,185

Related U.S. Application Data

[63] Continuation-in-part of Ser. No. 429,501, Jan. 2, 1974, abandoned.

[52] U.S. Cl. ..... 208/11 R; 208/8; 48/197 R; 201/12; 201/21; 201/31

[51] Int. Cl.[2] ..... C10G 1/02

[58] Field of Search ..... 208/8, 11; 201/10, 12, 201/21, 31; 48/197 R, 202

[56] References Cited

UNITED STATES PATENTS

| | | | |
|---|---|---|---|
| 2,474,345 | 6/1949 | Clark et al. | 48/197 R |
| 2,550,432 | 4/1951 | Thompson | 208/11 |
| 2,982,701 | 5/1961 | Scott | 208/11 |
| 3,167,494 | 1/1965 | Crawford | 208/11 |
| 3,577,338 | 5/1971 | Gifford | 208/11 |
| 3,597,347 | 8/1971 | Ellington | 201/12 |
| 3,617,472 | 11/1971 | Schlinger et al. | 208/11 |

*Primary Examiner*—Herbert Levine
*Assistant Examiner*—James W. Hellwege

[57] ABSTRACT

This invention is a process for the continuous and simultaneous retorting and hydrocracking of the carbonaceous materials found in such carbon containing solids as oil shale, coal, tar sands, lignite, and/or other carbon containing solids, and/or heavy liquids to produce low boiling liquid hydro-carbons and/or a gaseous product suitable for the subsequent production of methane or synthetic natural gas. It is a process by which high to very high molecular weight carbonaceous materials can be effectively and economically converted at high yields to either a low boiling crude of from 30° to 60° API gravity or a gas suitable for the subsequent production of methane, or both. The process consists of creating a catalytically reactive mass, whose active component is activated spent shale, in a reaction zone to which is fed oil shale or a mixture of oil shale and other carbonaceous feeds to be liquified-gasified, and the liquifying-gasifying agents, steam and oxygen; and from which is obtained a low boiling liquid hydrocarbon and gas, and spent shale and ash which are essentially free of any carbonaceous residue. The temperature at which the reaction zone is operated determines to a great extent the relative distribution of the products between liquids and gases. The higher the temperature the greater will be the percentage of the feed which is gasified.

26 Claims, No Drawings

HYDROCRACKING PROCESS FOR THE PRODUCTION OF SYNTHETIC FUELS

BACKGROUND OF THE INVENTION

This application is a continuation-in-part application of my application Ser. No. 429,501 filed in the U.S. Patent Office Jan. 2, 1974 now abandoned. It is also directly related to Disclosure Document No. 028241 dated Feb. 8, 1974 which was filed in the U.S. Patent Office.

There is one flaw in all existing oil shale processes as they are presently contemplated. In those processes wherein the kerogen or its thermal decomposition products are exposed to the spent shale, the cracking catalyst which occurs naturally in the mineral portion of oil shale has not been activated, and in those processes where the conditions are right for activation of the naturally occurring catalyst, the kerogen or its thermal decomposition products never "see" or are exposed to the active cracking catalyst, and as a result, no significant amount of cracking of the high molecular weight carbonaceous feeds is observed. This invention is based on the recognition of this serious deficiency and on a method of remedying it.

The need for better processes to produce both liquid and gaseous hydrocarbons from solid fossil fuels in this country is evident to one skilled in the art. Most existing oil shale processes product a crude which is high boiling and has a high pour point; that is, they produce a relatively poor quality crude. To convert this crude to salable products at a yield comparable to an average conventional crude is going to require a significant amount of downstream hydrogen processing. At the same time, existing processes to product liquid hydrocarbons from coal and other solid and/or heavy liquid carbonaceous fuels are generally hydrogen consumers, very high pressure, and they usually produce both a poor quality crude and a char.

Of the existing solid fuels gasification processes the Lurgi Process for coal is the most technologically advanced. In order to completely gasify the char, the Lurgi Process must be operated at such high temperatures that a significant portion of the product gas must be methanated — thus reducing its thermal efficiency. Other, more complicated processes, such as the HyGas, the Bi-Gas, and the Synthane attempt to produce methane directly from carbon and hydrogen by using higher pressures at lower temperatures, but they only incrementally increase the thermal efficiency over the Lurgi, and are much more complicated.

SUMMARY OF THE INVENTION

This invention is a process for the simultaneous retorting and in situ hydrocracking of carbonaceous materials in general as, for example, oil shale, coal, tar sands, and lignite. The catalytic effects of activated spent shale are utilized to produce the desired results — a high yield of either low boiling liquid hydrocarbons or of a gas suitable for the subsequent production of methane or synthetic natural gas, or a significant yield of both. Although the process of the invention is illustrated in the examples by the use of coal and/or raw oil shale as the carbonaceous materials being hydrocarcked, it is by no means limited to these materials as it can be used for the hydrocracking of carbonaceous material in general. It is a requirement of the invention that activated spent oil shale be present in the reaction zone because of its catalytic effect on the hydrocracking reactions. The activated spent shale can be made in situ in the continuous process as illustrated by the examples or it can be made outside the process and fed continuously to the reaction zone.

Typically, this invention can be performed in a continuous, pressurized, fluidized bed or some variation thereof. Whatever apparatus is used, it is important that good solids mixing exists in the reaction zone and that the reactive mass is free flowing at all times and places in the reaction zone. The expression "a system for hydrocracking carbonaceous materials", as used herein and in the claims, means conventional systems including retorts, fluid bed reactors, and other equipment in which carbonaceous materials are subjected to hydrocracking conditions. By "reaction zone of a system for hydrocracking carbonaceous materials", as used herein and in the claims, is meant the area within the system wherein temperature, pressure and other conditions exist to promote hydrocracking reactions.

The process is performed by first producing a catalytically reactive mass in a reaction zone. This is a startup step and needs to be performed only during the startup. The reaction zone is filled with raw shale, and, using steam and oxygen, the raw shale is retorted to a white, nonagglomerating spent shale which is activated when held above a minimum temperature of from 1000° to 1100°F. This assures a finite rate of carbonate decomposition in the presence of water. Although the simplest procedure has been described, the activated spent shale may be produced external to the reaction zone and added thereto, or the continuous feed composition may be used to produce the activated spent shale in situ.

Raw oil shale or a mixture of raw oil shale and other carbonaceous materials to be liquified and/or gasified is added continuously to the reactive mass. In the case of mixtures, spent oil shale may be substituted for raw oil shale where just the catalytic value, as opposed to its hydrocarbon value, of the shale is desired. The source of this spent shale may be any one of the existing oil shale processes. The point of introduction of this carbonaceous feed must be upstream of the activated spent shale which was provided in the startup step. By "spent shale" (spent oil shale), as referred to herein and in the claims, is meant the unactivated oil shale residue resulting from removal of the original associated carbonaceous materials by any means. By "activated spent shale" (activated spent oil shale), as used herein and in the claims, is meant spent oil shale which has been treated as described herein to at least partially decompose the carbonates therein and to convert it to its activated or catalytic state for catalyzing hydrocracking reactions.

Steam and oxygen are added simultaneously and continuously to the reactive mass. The steam is required for two reasons: (1) it is believed to be associated with the catalytic cracking activity of the activated spent shale, and (2) it reacts with the coke, char, or carbonaceous residue to produce the hydrogen required. The oxygen is added to supply the heat duty of the process. If the steam and oxygen or their reaction products do not provide sufficient agitation of the reactive mass to assure adequate solids mixing of the reactive mass, then other means of agitation must be employed. Such means could be, for example, mechanical agitation or the use of a recycle of a portion of the gaseous products to the bottom of the bed.

From the reactor is withdrawn continuously a low molecular weight hydrocarbon product and the spent material. The low molecular weight hydrocarbon product may be either a low boiling liquid of from about 30° to about 60°API or a gas suitable for the subsequent production of methane or synthetic natural gas, or both. The spent material, whose composition should be similar to that of the reactive mass in the reaction zone, should be essentially free of any carbonaceous residue.

In essence, this invention actually includes three process variations — a liquifaction variation, a gasification variation, or a combination of the two. It is to be understood, however when operated in either mode, liquifaction or gasification, some of the compliment product is obtained. When it is operated mainly as a liquifaction process, it is the purpose of this process to produce a low boiling, stable crude of from about 30° to bout 60°API from the volatile constituents of both the oil shale and the other carbonaceous materials being fed. This is believed to be accomplished through the catalytic cracking of the normally heavy thermal decomposition products, followed by the in situ hydrogenation of these cracked products. Although there is another possible mechanism, it is believed that the hydrogen is supplied through the catalyzed steam-carbon reaction, this carbon coming mainly from the lesser reactive char or coke which is normally left behind as a residue in other existing processes.

When operated mainly for the gasification of the carbonaceous feeds, it is the purpose of this process to produce a gaseous product which is suitable for the subsequent production of methane or synthetic natural gas at thermal efficiencies much higher than are presently obtained by the prior art processes. This again is believed to be accomplished through the more severe hydrocracking of the normally volatile constituents of the carbonaceous feeds with the hydrogen again coming from the catalyzed steam-carbon reaction. The distribution between liquid and gaseous products is determined mainly by the severity of operation, and the severity of the reaction zone, as used in this disclosure, is related primarily to the temperature of the reaction zone, but concentration of catalyst per unit volume of reactive mass is also a part of severity. The higher the severity the greater will be the percentage of gaseous products produced.

DESCRIPTION OF THE PREFERRED EMBODIMENTS

In order to clearly illustrate the invention the following detailed description of its operation as a continuous process is presented. Since there are essentially two different modes of operation, liquifaction and gasification, it will be necessary from time to time to digress into a description of one or the other of these modes. The only real operational difference between the two modes, however, is the severity of the reaction zone. Both modes depend heavily on the catalytic effects of activated spent shale to catalyze the hydrocarcking reactions.

A fluidized bed reactor is filled with raw oil shale. A fluidized bed reactor is a reactor in which the solids therein are buoyed up partially by the frictional drag of the upflowing gas and partially by the particle-to-particle interactions. An active fluid bed has many properties similar to that of a liquid, but it is a gas-solid mixture. Both radial and longitudinal solids mixing occurs rapidly in an active fluid bed. Using steam and oxygen, retort the raw oil shale; the pressure is maintained at about 400 psig and the temperature at about 1300° F (for liquifaction) or 1700° F (for gasification). The particle size and the superficial velocity of the gas phase should be adjusted to produce a fairly active bed. This will produce a white, nonagglomerating activated spent shale in which some of the carbonates have been decomposed and are decomposing in the presence of water. This is what is called in this disclosure activated spent shale, and is to be distinguished from the "reactive mass" or the "catalytically reactive mass" (they are the same) by the absence of any ash material obtained from the other possible feeds such as coal. The reactive mass must contain activated spent shale, but it does not necessarily have to be composed completely (as in this instance) of activated spent shale; its steady state composition depends entirely upon the subsequent continuous feed composition. It is to be noted that the activated spent shale is not exposed to the nitrogen of air.

This first step is a startup step and needs to be performed only during a startup of the process. The required composition of the subsequent carbonaceous feed mixture assures that fresh potential catalyst is continuously being added to the process. The initial charge of activated spent shale may be produced external to the reaction zone and added thereto, or the activated spent shale may be produced in situ from a feed mixture whose composition is similar to that of the carbonaceous feed mixture which follows. The simplest and easiest method has been described.

To the reactive mass add continuously raw oil shale or a mixture of raw oil shale and other carbonaceous materials to be liquified and/or gasified. An additional possible continuous feed composition would be a mixture of spent shale with the other carbonaceous materials. The spend shale may be obtained from any of the existing oil shale processes, such as the Tosco II Process, and in this case is added only as a source of future catalyst (activated spent shale) and not as a source of both products and future catalyst. All possible feed mixtures must contain some raw oil shale or spent oil shale to assure the continuous rejuvenation of the catalyst in the reactor. The other carbonaceous materials may include coal, tar sands, lignite, or other carbon containing solids, or heavy liquids, or mixtures thereof. The point of introduction of this carbonaceous feed must be upstream of the activated spent shale produced in the startup step. Upstream and downstream in this disclosure is determined solely by the direction in which the gas phase is flowing in the reaction zone. This point-of-introduction requirement is essential to insure that as the normally heavy thermal decomposition products are formed and carried along with the gas flow, they are exposed to activated spent shale before they leave the reactor. That is, activated spent shale, formed either during the startup or during subsequent operation of the process, must be located downstream of the place where the carbonaceous materials are introduced, or where their thermal decomposition products are formed.

Steam and oxygen are added simultaneously and continuously to the reaction zone. The steam is required to supply the hydrogen needed for the hydrogenation of the cracked molecules; it is also believed to be associated with the catalytic activity of the activated spent shale for cracking. The oxygen is added to supply the heat duty of the process. If either because of the point or points of addition or because of the rates of addition of the steam and oxygen, there is not sufficient agitation of the reactive mass to assure good solids mixing of the reactive mass, then the reactive mass must be agitated by other means. One example would be a mechanically stirred reactor. A preferred example would be through the use of a recycle of a portion of the gaseous products to the bottom of the bed. One of the advantages that a recycle would have would be to recover a portion of the sensible heat in the spent material. In other words, the reactive mass must be fairly homogeneous in composition, and if because of the chemistry requirements of the process of the flow rates of the steam and oxygen or their reaction products are not sufficient to guarentee good solids mixing of the reactive mass, then other means should be used. This assures that activated spent shale is always present downstream of the point of introduction of the carbonaceous feeds even though the catalyst is continually being used up and discharged from the reaction zone.

From the reactor are withdrawn continuously low molecular weight hydrocarbon products. If the preferred mode of operation is liquifaction, a low boiling liquid of from about 30° to about 60°API can be produced, and if the preferred mode of operation is gasification, then a gas suitable for the subsequent production of methane or synthetic natural gas is the product. The liquids may be separated from the gases by cooling and condensing before pressure reduction. The severity of the reaction zone will determine the relative distribution between liquids and gases; the higher the severity the greater will be the percentage of the feed which is gasified.

From the reactor is withdrawn continuously the spent material. If adequate solids mixing exists in the reaction zone, the composition of this spent material will be approximately the same as that existing in the bed. The rate of withdrawal of the spent material is adjusted to hold a constant level of solids in the bed while making sure that essentially no carbonaceous residue remains in this material.

Following is a detailed description of what is believed to occur inside the reaction zone during steady state operation of the process. It is divided into two parts: (1) the mechanism of an oil shale particle, and (2) the mechanism of a coal particle. The description of the coal particle mechanism is believed to be representative of all other carbonaceous feeds.

As the oil shale particle enters the hot reactive mass rapid heat transfer causes the kerogen to immediately begin to decompose into gas, heavy liquids, and a coke or carbon which is deposited on the spent shale. The gas and heavy liquids are rapidly boiled out of the particle. As the gas and heavy liquids are carried along by the flowing gas phase, the heavy liquids are exposed to activated spent shale which is located downstream. The heavy liquids are adsorbed onto the activated spent shale and subsequently cracked to lower molecular weight fragments. The coke or carbon left behind on the spent shale reacts with the water present to produce hydrogen through the catalyzed steam-carbon reaction. The hydrogen is carried along by the flowing gas phase and then reacts with the reactive molecular fragments from the cracking reactions. Another, equally possible mechanism involves the direct reaction between adsorbed water and adsorbed heavy hydrocarbons. As the spent shale is denuded of carbon it becomes white in color, and at around 1000° to 1100°F the carbonates begin to decompose. In the presence of water this particle then becomes a particle of activated spent shale, and because good solids mixing exists in the bed, it is moved upwards where it becomes the catalyst for subsequent cracking of additional heavy liquids. In the case where spent shale from an external source is fed continuously with the carbonaceous feed, the same mechanism applies; only there is no kerogen to be initially decomposed. The severity at which this mechanism occurs determines the extent of cracking; higher severities favor the production of lower molecular weight products.

The mechanism described above differs greatly from that occurring in the process of U.S. Pat. No. 3,577,338 in that, in the later process, once the kerogen decomposes and the heavy decomposition products are carried along with the gas, they become rapidly cooler and are exposed only to raw oil shale. Thus the heavy thermal decomposition products never have an opportunity to be exposed to the activated spent shale produced by the process, and therefore, the process produces a crude of from 18° to 22°API. In contrast, the crux of the present invention is based on the realization that when the thermal decomposition products of oil shale and other carbonaceous materials are exposed to activated spent shale under pressure and above a minimum temperature of from 1000° to 1100° F in the presence of water, the activated spent shale which is formed under these conditions acts as a catalyst and cracking and hydrogenation occurs.

In the case of the coal particle (or other carbonaceous feed materials) a different intermediate residual product is obtained. That is, with these particles no fresh potential catalyst is added to the reactive mass. As the coal particle enters the hot reactive mass it thermally decomposes into gas, heavy liquids, and a char or coke particle. The fate of the gas and heavy liquids is the same as that of the gas and heavy liquids obtained from the decomposition of the kerogen. The coke or char particle is, however, not in as intimate a contact with the spent shale as was the carbon residue obtained from the kerogen. Since it is known that the coke or char particle reacts to extinction in this process (or to whatever ash it may contain) it is believed that this particle is induced to react, even at the lower liquifaction temperatures, with the steam present to produce hydrogen through the mechanism of multiple collisions which it subsequently suffers with the particles of activated spent shale. This is one of the reasons why it is believed that an active fluid bed, a bed in which there are many collisions per unit time per unit volume, is necessary for successful operation of this process.

The following four examples are presented to show the liquifaction capabilities of the subject invention.

EXAMPLE 1

In the following example a medium volatile bituminous coal and raw shale were used as the carbonaceous feeds. The oil shale was from the southern rim of the Piceance Creek Basin and had a Fischer Assay of around 30 gal/ton. The approximate and ultimate analyses of the coal used in all runs as supplied by the producer are:

| | | | | | |
|---|---|---|---|---|---|
| Moisture | 7 | w% | Carbon | 82 | w% |
| Fixed Carbon | 70 | w% | Hydrogen | 5 | w% |

-continued

| | | | | | |
|---|---|---|---|---|---|
| Volatile Matter | 25 | w% | Nitrogen | 2 | w% |
| Ash. | 7 | w% | Sulfur | 0.5 | w% |
| | | | Ash | 7 | w% |
| | | | Oxygen | 3 | w% |

The heating value of the coal was given as 15,000 BTU/lb. The size distribution of the shale-coal mixture for this example and the next three was approximately −10 +60 mesh USS.

Three pounds of coal and one pound of oil shale having the composition described above were placed into a batch reactor. Although a batch process is used for illustrating the invention, the process is readily adaptable to a continuous process for commercial operation. The steady state composition of the reactive mass is very different from that of the fresh feed mixture; hence an unavoidable transition period must occur during batch operation.

Superheated steam at around 100°F was introduced into the well insulated reactor until the ignition temperature of the contents was reached, and then the oxygen blast was performed. A deliberate attempt was made to bring the contents of the reactor up to the quasi steady state operating temperature as fast as possible in order to simulate continuous operation. This was accomplished by a short blast of pure oxygen before the run started but after the ignition temperature and been reached; that is, in most runs a rate of 6 scfm for approximately 15 seconds was used. This blast was believed to produce some spent shale on the outer surface of the reactive oil shale particles in a very short period of time; it also brought the contents of the reaction zone up to the reaction temperature rapidly. The use of the oxygen blast is not a requisite of the invention but was used only to simulate a continuous process. The run conditions for the steam and oxygen for this run were 6 scfm and 0.8 scfm respectively with the use of 60° F as standard temperature and 1 atmosphere as standard pressure. The products from the reactor passed through an ice bath trap used to contain the condensables and then through a pressure reducer. In this example and the following three no attempt was made to analyze the gaseous products; such results are presented in Examples 5 and 6 below.

In this example 432 cc of a 35°API crude were produced from the four pounds of feed. The maximum temperature of the run as measured 3 inches above the porous stainless steel gas distributor was approximately 1400° F, but this was reached toward the end of the run after a steady rise in temperature from around 1100° F at or near the start of the run. The oxygen blast was usually started when the contents of the reactor reached from 500° to 700° F which is sufficient for ignition when oil shale is present. The pressure was set at 400 psig and held there during the entire run. The run lasted approximately 12 minutes or a little longer, and the end was determined by a rapid decrease in temperature in the reactor. An examination of the spent shale and ash showed that little or no carbonaceous material remained in the reactor. That is, the spent shale and ash were very light in color. A small amount of fine particles or dust was found in the ice bath trap with the liquid, indicating some entrainment from the reactor to the trap.

Although there is nothing in the prior art to compare it with, the yield for this run was 1.36 barrels of oil per ton of feed. The oil had an API gravity of 35° and was translucent with a tan to greenish color; it also had a fluorescent cast which indicates the presence of aromatics therein. When existing coal liquifaction processes are considered, the yield of 1.36 bbl/ton is not too bad (and the feed was only ¾ coal), and it is felt that this yield would be improved through continuous operation where the reactive mass is at steady state with respect to composition and temperature when the fresh feed is introduced. Also, this was a medium volatility coal, and with the proper precautions higher volatility coals could be used giving more barrels of oil per ton of feed. A medium volatile coal was used because of startup considerations.

EXAMPLE 2

Two pounds of a medium volatile bituminous coal and 2 pounds of oil shale were placed into the same batch reactor. The Fischer Assay of the shale was 30 gal/ton, and the ultimate and approximate analyses of the coal were the same as in Example 1. The run conditions for the steam and oxygen were 6 scfm and 0.7 scfm respectively. Again the contents of the reactor were preheated with 1000°F steam, and at the ignition temperature the oxygen blast was performed, and then the run was started.

In this run 366 cc of a 43°API gravity crude were obtained in the ice bath trap. The oil was somewhat lighter in color and still had the fluorescent cast. As can be seen, less oil was produced from this 4 pounds of feed (relative to Example 1), but the quality was much better; that is, 43° versus 35°API crude. The yield of oil per ton of carbonaceous feed calculates to be 1.15 bbl/ton. The pressure in the reactor was again held at 400 psig, and the temperature range was approximately from 1100° to around 1500° F with the maximum being attained at the end of the run. Less oxygen was fed because in an unreported run where 0.8 scfm was used with a 50—50 mixture, the temperature became excessive for liquifaction. As can already be seen, and as will be more clearly pointed out in the next two examples, the gravity of the crude produced is very sensitive to the oxygen rate and the percentage of raw shale in the feed. That is, the gravity of the crude produced changes rapidly with the severity of the reaction zone.

EXAMPLE 3

One pound of a medium volatile bituminous coal and three pounds of oil shale having the compositions as disclosed in the previous examples were placed into the batch reactor. All other conditions and procedures were the same except that the oxygen rate was lowered again to 0.6 scfm. The amount of oil contained in the ice bath trap decreased to 295 cc of a 51°API gravity crude. The oil seemed to be more greenish and less tan, but the fluorescence was still very apparent. The yield in this example calculates to be 0.93 bbl/ton. The temperature ranges was from approximately 1200° to 1550° F indicating maybe a little too much oxygen was being fed for maximizing liquids recovery. Examination of the spend shale and ash showed that little or no carbonaceous material remained, and there was some dust in the ice bath trap with the oil.

EXAMPLE 4

Four pounds of a 30 gal/ton oil shale were placed into the same well insulated reactor. All conditions and procedures were the same as in the previous examples except that the oxygen rate was reduced to 0.5 scfm. The amount of oil in the ice bath trap was 220 cc, and it had an API gravity of 55°. This is essentially a heavy naphtha. This volume of oil gives a yield of 97% of the Fischer Assay which is an exceptional yield when one considers the quality of the crude relative to the quality produced by other existing oil shale processes at comparable yields. The pressure was held at 400 psig, and the temperature range was from around 1200° to 1600° F. The spent shale was completely denuded of carbon; hence it was very white in color. From these results it can be concluded that (1) although thermal cracking is possible at these temperatures, it can be ruled out; the yield distribution favors too much low boiling liquids, and (2) that it is very likely probable and possible to get from the rock to gasoline in essentially three plants — the retort-hydrocracker, a hydrotreater for the removal of nitrogen, and a reformer, and it could be done with upwards of 60 to 80% of the Fischer Assay. Economically, this compares very favorably with the yields which are presently being obtained in existing refineries charging conventional crude.

The four previous examples were presented to show the liquifaction capabilities of the subject invention. Where the prior art processes, Gas Combustion, Tosco II, and U.S. Pat. No. 3,577,338, tend to produce a liquid product of from 18° to 22° API gravity, this process produces a liquid product of from about 30° to about 60°API. That is, a much higher quality crude was produced by the subject invention without a significant loss of yield, and it was shown that the feed material does not necessarily have to be 100% oil shale. In other words, the activated spent shale can be used to hydrocrack other carbonaceous materials. Since the feed composition can vary over rather broad limits, and because the desired API of the product crude may be different from operator to operator, the possible ranges of the process variables are very broad. However, when liquifaction of the carbonaceous feed mixture is the main goal, the process variable ranges are as follows: the weight percent of oil shale in the carbonaceous feed mixture is from 100% down to about 5% oil shale — the remainder being other carbonaceous materials such as coal, tar sands, lignite, etc. which are to be liquified; the rate of introduction of said carbonaceous materials is adjusted to produce a spent material which is essentially free of any carbonaceous residue; the oxygen is from about 500 to about 10,000 standard cubic feet per ton of carbonaceous feeds; the steam is from about 5,000 to about 100,000 standard cubic feet per ton of carbonaceous feeds (assuming steam to be a gas at standard temperature and pressure); the preheat temperature of the steam and oxygen feeds is from ambient to about 2000° F; the reaction zone pressure is from atmospheric to about 2000 psig with a preferred pressure range from about 200 to about 1000 psig; and the temperature of the reaction zone is from about 1000° to about 1600° F. The reaction zone temperature range assures not only that there is a finite rate of carbonate decomposition but also that the composition of the reactive mass will be free flowing at all times and places in the reaction zone.

The following two examples are presented to show the gasification capabilities of the subject invention.

EXAMPLE 5

Three pounds of a medium volatile bituminous coal were placed into the batch reactor. The approximate and ultimate analyses of this coal are the same as that given in Example 1. With this coal was added 0.3 pound of spent shale which was prepared according to the procedure given in U.S. Pat. No. 3,577,338 (batch retorting of raw shale using steam and oxygen) and which was transferred to the reactor with a minimum amount of exposure to the atmosphere. The Fischer Assay of the raw shale, before being retorted, was 30 gal/ton. The size distribution of the coal and spent shale for this example and the next example was −6 +35 mesh USS. Superheated steam at 1000° F was introduced into the well insulated reactor, and then the oxygen and run were started. No oxygen blast was used in this or the next example. The run conditions for the steam and oxygen were approximately 6 and 1 scfm respectively. At the start of the run the off-gas was diverted through a wet test meter which was located after the ice bath trap and pressure reducer. The run continued until oxygen breakthrough occurred or until the temperature in the reactor dropped suddenly. This generally occurred around 15 minutes from the start of the run. The amount of off-gas and its composition and the amount of organic liquid contained in the ice bath trap were then determined. Also the ash and spent shale were examined for appearance. In all gasification experiments very little or no carbonaceous material was left in the reactor.

In this experiment the amount of off-gas was 127 scf and its composition was:

| | |
|---|---|
| $H_2$ | 42 v% |
| CO | 18 v% |
| $CO_2$ | 19 v% |
| $CH_4$ | 21 v% |

Some oxygen slip which occurred during the later portion of the run was normalized out. The reactor pressure was held at 400 psig, and the steam-oxygen feed temperature was around 1000° F during the run. The maximum temperature in the reactor during the run was approximately 1800° F, but this was attained at the end of the run after a steady rise in temperature from around 1500° F at or near the start of the run.

After the off-gas is shifted to a 3/1 $H_2$/CO ratio and the resulting $CO_2$ is removed and the resulting remaining gas is methanated, the resulting heating value of the methane produced is 1.04 times the heating value of the three pounds of coal consumed. That is, the thermal efficiency (based only on the gas produced) is 104%. If the heating value of the organic liquids produced is included, the efficiency would be about 6% higher. Thus, relative to say the Lurgi Process, it can be seen that some gas was produced at the expense of liquids. The corresponding thermal efficiencies as reported in the literature for the Lurgi Process are 70% (based only on the gas produced) and 90% respectively.

EXAMPLE 6

Three pounds of the same coal as used in all of the above examples were placed into the same reactor. With this coal was placed 0.3 pound of the raw shale having a Fischer Assay of around 25 gal/ton. The size distribution and the run conditions were the same as in Example 5. After correcting for the small amount of gas obtained from the kerogen and carbonate decomposition of the oil shale, the resulting amount and composition of the gas obtained from the coal was about the same as that given in Example 5. That is, 127 scf and:

| | |
|---|---|
| $H_2$ | 42 v% |
| CO | 18 v% |
| $CO_2$ | 19 v% |
| $CH_4$ | 21 v% |

Thus, the thermal efficiency, based only on the gas produced, for this run was also around 104%. A little more liquid product was produced, but if one eliminates the small amount of shale oil possible under these conditions, this too was about the same as in the previous example.

These last two examples were presented to show the gasification capabilities of the process. One skilled in the art can see from the results that thermal efficiencies, relative to the prior art processes, are significantly higher. It is believed that the subject invention tends to hydrocrack the carbonaceous feeds much more effectively than do those prior art processes. When operating this process mainly for the gasification of the carbonaceous feeds, the following broad ranges of the process variables are recommended: the weight percent of oil shale in the carbonaceous feed mixture from 100% down to about 1% oil shale — the remainder being other carbonaceous materials to be gasified; the temperature of the reaction zone is from about 1400° to about 2000° F; and the remainder of the process variable ranges are the same as those given for the liquifaction mode of operation.

All runs were designed to obtain some degree of fluidization, and some fluidization was obtained as evidenced by small particles of dust contained in the oil in the ice bath trap. It is difficult, however, when one considers that the particle size and density, especially of the consumed coal particles, is continually changing during the course of the particle's life in the reactor. The oil shale particles retain their structural integrity to some extent, but wearing and rounding of the surface and corners of these particles was evident. It is postulated here that this wearing away of the surface of the oil shale particles is a necessary part of the solid-to-solid catalytic effects of the activated spent shale. That is, particle-to-particle collisions with the consequent wearing away of the surface, because of the carbonate decomposition and its resultant loss of structural strength, is believed to be a necessary part of this process. It is especially necessary after the volatile material of the coal particle has been thermally driven off, leaving the lesser reactive fixed carbon or char. If this char or coke cannot be induced to react at these lower temperatures (speaking now mainly of the liquifaction mode of operation) with the water present to produce the hydrogen required for the hydrogenation of the molecular fragments, then the process would tend to produce an unstable, olefinic liquid product. Polymerization to coke by the intermediate reactive fragments would also be a problem at these temperatures. The results show, however, that this has not happened. First of all, no carbonaceous residue was found in the spent material; that is, the char or coke particles reacted to extinction. Secondly, although no PONA's (the concentrations of paraffins, olefins, naphthenes, and aromatics) were obtained on the liquid products, they were not unstable in air at room temperature over long periods of time, and thirdly, the yield of low boiling liquid products is much too high.

From the above results it must be concluded that there is a catalytic effect by the activated spent shale for at least cracking of the thermal decomposition products of the feeds. Although dehydrogenation of these cracked products must occur, it may or may not be catalyzed by the activated spent shale. In the closest prior art process (U.S. Pat. No. 3,577,338) the catalyzed steam-carbon reaction to produce hydrogen was taught, but because of the manner in which the process was conducted, cracking of the high molecular weight thermal decomposition products and subsequent hydrogenation of these cracked products was not possible. The process (U.S. Pat. No. 3,577,338) and many of the other prior art processes produce a crude of from 18° to 22° API gravity. They also tend to produce a crude having a high (80° F) pour point. The process of the subject invention produces a crude of from about 30° to about 60° API with a very low pour point, and if the observed cracking were thermal only and not catalytically induced, the yield structure of the liquid products could not possibly have been as high in low boiling liquids as has been observed. That is, when a 20° API gravity crude is thermally cracked, the highest yield one can possibly expect in the gasoline or naphtha boiling range is from 40 to 50 volume percent. In Example 4, a yield of 97% of a 55° API gravity crude was obtained. This yield of this product at the temperature range reported (1200° to 1600°F) and the fact that the liquid product was found to be stable in air at room temperature over long periods of time, is also why it is believed that hydrogenation of the cracked molecules occurs readily. The difference between the process of the subject invention and the prior art processes is therefore attributed, in part, to the newly discovered catalytic role of the activated spent shale, as well as the discovery that the activated spent shale must be located downstream of the place where the carbonaceous feeds are introduced, or where their normally heavy volatile constitutents are thermally driven off.

In the Tosco II Process, as representative of a certain body of thinking in the prior art, there is sufficient opportunity for both the kerogen and its thermal decomposition products to be exposed to the spent shale, but the temperature used in the reaction zone is too low for activation of the spent shale. In that process, as well as many other prior art processes, it is taught that the thermal decomposition of the carbonates found in the oil shale is to be avoided as wasteful of heat. That is, it is taught that the temperature of the reaction zone is to be kept sufficiently low so as to minimize the amount of carbonate decomposition. The exact opposite is taught in the present invention. In fact, the minimum temperature of the reaction zone is directly related to the minimum temperature at which the carbonates begin to decompose. It is believed that much of this body of thought resulted from the early research on the Fischer Assay method, where it was discovered that the maximum volumetric yield of oil was obtained at a retorting temperature of around 935° F with little or no carbonate decomposition. The oil produced, however, was a heavy, high boiling crude.

Although little is known presently about the mechanism of activation of the spent shale, it is strongly believed to be associated with or it occurs as the result of the carbonate decomposition. Shale oil which has been produced under conditions of no carbonate decomposition is heavy and high boiling; while a relatively low boiling crude has been produced under conditions where the carbonates are decomposing or have been decomposed. As reported in the literature, the thermal decomposition of the carbonates found in oil shale begins at around 1000° to 1100° F, and they have an appreciable rate at around 1500° to 1600° F. The presence of water is also believed to be necessary for activation.

Another strong possibility in this area of activation is exposure of activated catalyst as a result of loss of structural strength due to carbonate decomposition. For example, it is known that nitrogen compounds act as an inhibitor in conventional catalytic cracking reactions, and it is known that kerogen is loaded with nitrogen compounds, but if fresh surface and fresh catalyst are continually being exposed as a result of wearing away of the outer surface (this being caused by the many particle-to-particle collisions and the loss of structural strength due to carbonate decomposition), then the inhibiting effect of the nitrogen would be avoided. In the Tosco II Process very little or no carbonate decomposition occurs; it is purposefully avoided.

In summary, the invention provides an improved process for the liquifaction and/or gasification of solid carbonaceous fossil fuels. Because it contains the future catalyst, some oil shale or spent shale is an absolutely necessary component of the feed, and its presence with other carbonceous feeds makes liquifaction and/or gasification of these feeds more economic; that is, the resulting liquid product is of much higher quality, and/or the resulting amount and composition of the gas produced gives a much higher overall thermal efficiency.

I claim:

1. A continuous process for the production of useful products from carbonaceous materials, such as oil shale, coal, tar sands, lignite, or other carbon-containing solids, or heavy carbonaceous liquids, or mixtures thereof, by catalytically hydrocracking said carbonaceous materials, wherein activated spent oil shale, a catalyst which is derived from either raw oil shale or spent oil shale by treating said raw or spent oil shale in the presence of steam under heat and other conditions which promote decomposition of the carbonates found therein, is used to catalyze the hydrocracking reactions to thereby produce relatively low molecular weight hydrocarbon products, the continuous process comprising the following:

a. providing a particulate reactive mass containing activated spent oil shale in a reaction zone of a system for hydrocracking carbonaceous materials;
b. feeding steam and oxygen continuously to the reaction zone, the steam to provide the hydrogen needed for the hydrocracking reactions, and the oxygen to supply the heat duty of the process, these feed gases or their reaction products forming a fluid bed in said reaction zone and also acting as a sweep gas through the reactive mass;
c. feeding continuously to the reaction zone a feed including at least one of said carbonaceous materials and a precursor for activated spent oil shale selected from the group consisting of raw oil shale and spent oil shale as necessary to maintain adequate activated spent oil shale in said reaction zone to catalyze said hydrocracking, while maintaining conditions in the reaction zone which insure the the continued presence of said activated spent oil shale therein, the point of introduction of said carbonaceous materials into said reactive mass being upstream relative to at least some of the activated spent oil shale present;
d. continuously withdrawng relatively low molecular weight hydrocarbon products from the system with the sweep gas; and
e. continuously withdrawing spent material from the system.

2. The process of claim 1 in which the said activated spent oil shale is produced outside the reaction zone and added thereto.

3. The process of claim 1 in which the activated spent oil shale is formed in-situ by heating the feed material used in step (c) in the presence of steam and oxygen and above a minimum temperature of about 1000° to 1100° F.

4. The process of claim 1 in which sufficient agitation of the reactive mass to produce good solids mixing of the reactive mass is assured through the use of at least some mechanical means.

5. The process of claim 1 in which sufficient agitation of the reactive mass to produce good solids mixing of the reactive mass is assured through the use of a recycle of a portion of the gaseous products to the bottom of the bed.

6. The process of claim 1 in which said low molecular weight hydrocarbon products comprise primarily a low boiling liquid with an API gravity of about 30° to about 60° API.

7. The process of claim 6 in which the temperature of the reaction zone ranges from about 1000° to about 1600° F thus insuring a finite rate of carbonate decomposition and a composition of the reactive mass which is free flowing at all times and places in the reaction zone.

8. The process of claim 6 in which the weight percent of raw oil shale in the carbonaceous feed mixture ranges from 100% down to about 5% raw oil shale — the remainder being other solid and/or heavy liquid carbonaceous materials to be liquified.

9. The process of claim 1 in which said low molecular weight hydrocarbon products comprise primarily a gas or gases suitable for the subsequent production of methane or synthetic natural gas.

10. The process of claim 9 in which the temperature of the reaction zone ranges from about 1400° to about 2000° F thus insuring a finite rate of carbonate decomposition and a composition of the reactive mass which is free flowing at all times and places in the reaction zone.

11. The process of claim 9 in which the weight percent of raw oil shale in the carbonaceous feed mixture ranges from 100% down to about 1% raw oil shale — the remainder being other solid and/or heavy liquid carbonaceous materials to be gasified.

12. The process of claim 1 in which said low molecular weight hydrocarbon products comprise a mixture of both low boiling liquids of about 30° to about 60° API and a gas suitable for the subsequent production of methane or synthetic natural gas.

13. The process of claim 1 in which the pressure of the reaction zone ranges from about atmospheric to about 2000 psig.

14. The process of claim 13 in which the pressure of the reaction zone ranges from about 200 to about 1000 psig.

15. The process of claim 1 in which the liquifying-gasifying agents, steam and oxygen, are fed to the reaction zone at a temperature between ambient and about 2000° F.

16. The process of claim 1 in which the ranges of the amounts of steam and oxygen being fed to the reaction zone are: for steam about 1,000 to about 100,000 standard cubic feet per ton of carbonaceous feeds, and for oxygen about 500 to about 10,000 standard cubic feet per ton of carbonaceous feeds.

17. The process of claim 1 in which the rate of introduction of the carbonaceous feed mixture is adjusted to produce a spent material which is essentially free of any carbonaceous residue.

18. The process of claim 1 in which a portion of the gaseous product from the reaction zone is recycled back to the reaction zone.

19. The process of claim 1 in which the activated spent oil shale is present in the reactive mass by virtue of a startup step in which raw oil shale or spent oil shale is initially heated in the reaction zone in the presence of steam and oxygen and above a minimum temperature of about 1000° to 1100° F thus assuring a finite rate of decomposition of the carbonates found in said raw or spent oil shale, the presence of water or steam, and the production of activated spent shale.

20. In processes in which carbonaceous materials, such as oil shale, coal, tar sands, lignite, or other carbon-containing solids, or heavy carbonaceous liquids, or mixtures thereof, are catalytically hydrocracked by heat and other means in a reaction zone under conditions which yield lower molecular weight hydrocarbon products, the improvement which comprises forming a fluid bed in said reaction zone and contacting the carbonaceous materials in said reaction zone with activated spent oil shale, a catalyst which is derived from either raw oil shale or spent oil shale by treating said raw or spent oil shale in the presence of steam under heat and other conditions which promote decomposition of the carbonates found therein, to catalyze the hydrocracking reactions.

21. The process of claim 20 in which the heat is supplied by the addition of oxygen.

22. The process of claim 20 in which the hydrogen required for hydrocracking is produced in-situ by the reaction of added carbon and steam.

23. A continuous process for the production of useful products from carbonaceous materials, such as coal, tar sands, lignite, or other carbon-containing solids, or heavy carbonaceous liquids, or mixtures thereof, by catalytically hydrocracking said carbonaceous materials, wherein activated spent oil shale, a catalyst which is derived from either raw oil shale or spent oil shale by treating said raw or spent oil shale in the presence of steam under heat and other conditions which promote decomposition of the carbonates found therein, is used to catalyze the hydrocracking reactions to thereby produce relatively low molecular weight hydrocarbon products, the continuous process comprising the following:

a. providing a particulate reactive mass containing activated spent oil shale in a reaction zone of a system for hydrocracking carbonaceous materials;
b. feeding steam and oxygen continuously to the reaction zone, the steam to provide the hydrogen needed for the hydrocracking reactions, and the oxygen to supply the heat duty of the process, these feed gases or their reaction products forming a fluid bed in said reaction zone and also acting as a sweep gas through the reactive mass;
c. feeding continuously to the reaction zone a feed including at least one of said carbonaceous materials and spent oil shale, while maintaining conditions in the reaction zone which insure the continued presence of said activated spent oil shale therein, the point of introduction of said carbonaceous materials into said reactive mass being upstream relative to at least some of the activated spent oil shale present;
d. continuously withdrawing relatively low molecular weight hydrocarbon products from the system with the sweep gas; and
e. continuously withdrawing spent material from the system.

24. In processes in which carbonaceous materials, such as oil shale, coal, tar sands, lignite, or other carbon-containing solids, or heavy carbonaceous liquids, or mixtures thereof, are catalytically hydrocracked by heat and other means in a reaction zone under conditions which yield useful liquid hydrocarbon fuels, the improvement which comprises forming a fluid bed in said reaction zone and contacting the carbonaceous materials in said reaction zone with activated spent oil shale, a catalyst which is derived from either raw oil shale or spent oil shale by treating said raw or spent oil shale in the presence of steam under heat and other conditions which promote decomposition of the carbonates found therein, to catalyze the hydrocracking reactions.

25. In processes in which carbonaceous materials, such as oil shale, coal, tar sands, lignite, or other carbon-containing solids, or heavy carbonaceous liquids, or mixtures thereof, are catalytically hydrocracked by heat and other means in a reaction zone under conditions which yield useful lower molecular weight gaseous hydrocarbon products suitable for the subsequent production of synthetic natural gas, the improvement which comprises forming a fluid bed in said reaction zone and contacting the carbonaceous materials in said reaction zone with activated spent oil shale, a catalyst which is derived from either raw oil shale or spent oil shale by treating said raw or spent oil shale in the presence of steam under heat and other conditions which promote decomposition of the carbonates found therein, to catalyze the hydrocracking reactions.

26. A continuous process for the production of useful products from carbonaceous materials, such as oil shale, coal, tar sands, lignite, or other carbon-containing solids, or heavy carbonaceous liquids, or mixtures thereof, by catalytically hydrocracking said carbonaceous materials, wherein activated spent oil shale, a catalyst which is derived from either raw oil shale or spent oil shale by treating said raw or spent oil shale in the presence of steam under heat and other conditions which promote decomposition of the carbonates found therein, is used to catalyze the hydrocracking reactions to thereby produce relatively low molecular weight hydrocarbon products, the continuous process comprising the following:

a. providing a particulate reactive mass containing activated spent oil shale in a reaction zone of a system for hydrocracking carbonaceous materials;
b. feeding steam and oxygen continuously to the reaction zone, the steam to provide the hydrogen needed for the hydrocracking reactions, and the oxygen to supply the heat duty of the process, these feed gases or their reaction products forming a fluid bed in said reaction zone and also acting as a sweep gas through the reactive mass;

c. feeding continuously to the reaction zone a feed of said carbonaceous materials, comprising either raw oil shale or mixtures of raw oil shale and other carbonaceous materials, while maintaining conditions in the reaction zone which insure the continued presence of said activated spent oil shale therein, the point of introduction of said carbonaceous materials into said reactive mass being upstream relative to at least some of the activated spent oil shale present;

d. continuously withdrawing relatively low molecular weight hydrocarbon products from the system with the sweep gas; and e. continuously withdrawing spent material from the system.

* * * * *

UNITED STATES PATENT OFFICE

CERTIFICATE OF CORRECTION

Patent No. 4,001,105 Dated January 4, 1977

Inventor(s) Phillip H. Gifford II

It is certified that error appears in the above-identified patent and that said Letters Patent are hereby corrected as shown below:

Column 7 line 21, change "100°F" to --1000°F--.

Column 12 line 6, change "dehydrogenation" to --hydrogenation--.

Signed and Sealed this

Twenty-first Day of June 1977

[SEAL]

*Attest:*

RUTH C. MASON
*Attesting Officer*

C. MARSHALL DANN
*Commissioner of Patents and Trademarks*